US010079091B2

(12) United States Patent
Tozawa

(10) Patent No.: US 10,079,091 B2
(45) Date of Patent: Sep. 18, 2018

(54) METHOD FOR MANUFACTURING SINTERED MAGNET

(71) Applicant: DAIDO STEEL CO., LTD., Nagoya-shi (JP)

(72) Inventor: Yusuke Tozawa, Nagoya (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 236 days.

(21) Appl. No.: 15/215,486

(22) Filed: Jul. 20, 2016

(65) Prior Publication Data

US 2017/0025221 A1 Jan. 26, 2017

(30) Foreign Application Priority Data

Jul. 24, 2015 (JP) ..... 2015-146508

(51) Int. Cl.
*H01F 41/02* (2006.01)

(52) U.S. Cl.
CPC ..... *H01F 41/0266* (2013.01)

(58) Field of Classification Search
CPC ..... H01F 41/0266
See application file for complete search history.

(56) References Cited

U.S. PATENT DOCUMENTS

| | | | | |
|---|---|---|---|---|
| 2007/0245851 | A1* | 10/2007 | Sagawa | B22F 3/1021 75/10.67 |
| 2011/0250087 | A1 | 10/2011 | Sagawa | |
| 2014/0329007 | A1 | 11/2014 | Obata | |
| 2015/0179320 | A1 | 6/2015 | Furusawa et al. | |

FOREIGN PATENT DOCUMENTS

| | | | |
|---|---|---|---|
| CN | 1915632 | A | 2/2007 |
| CN | 1969347 | A | 5/2007 |
| CN | 104040655 | A | 9/2014 |
| CN | 104575919 | A | 4/2015 |
| CN | 104641434 | A | 5/2015 |
| JP | 2006-019521 | A | 1/2006 |
| JP | 2009-049202 | A | 3/2009 |
| JP | 2013-004557 | A | 7/2013 |
| JP | 2015-050880 | A | 3/2015 |
| JP | 2015-225880 | A | 12/2015 |

OTHER PUBLICATIONS

Chinese Office Action dated Jun. 12, 2018 in corresponding Chinese Application No. 201610581061.0, with an English translation thereof.

* cited by examiner

*Primary Examiner* — Jessee Roe
(74) *Attorney, Agent, or Firm* — McGinn IP Law Group, PLLC.

(57) ABSTRACT

The present invention relates to a method for manufacturing a sintered magnet, using a mold provided with a main body having a cavity and a lid whose inner face is flat, and the method containing a filling process of filling alloy powder in the cavity and then mounting the lid on the main body, an orienting process of applying a magnetic field in a predetermined direction to the alloy powder in a state of being filled in the cavity, a sintering process of sintering the alloy powder by heating in a state of being filled in the cavity after the orienting process, and a mold inverting process of turning the mold upside down which is carried out between the filling process and the orienting process or between the orienting process and the sintering process.

5 Claims, 5 Drawing Sheets

METHOD FOR MANUFACTURING SINTERED MAGNET

TECHNICAL FIELD

The present invention relates to a method for manufacturing sintered magnets usable for rotors or stators of motors.

BACKGROUND ART

In manufacturing sintered magnets, there has so far been adopted a method including filling a mold with alloy powder as a raw material (filling process), applying a magnetic field to the raw material alloy powder in the mold to orient particles of the raw material alloy powder (orienting process), applying pressure to the oriented raw material alloy powder to make a compression molded article (compression molding process), and performing sintering by heating the compression molded article after releasing the applied pressure (sintering process). Alternatively, there has been adopted a method in which, after the filling process, the orienting process and the compression molding process are carried out at the same time by applying pressure by the use of a press machine while applying a magnetic field to alloy powder as a raw material. At any rate, these methods each perform compression molding by the use of a press machine, and they are thus referred to as "press methods" in this specification.

In contrast to the press methods, there have been developed methods of performing, after filling a mold with alloy powder as a raw material, orientation and sintering of the alloy powder in a state of being held in the mold without carrying out compression molding, thereby manufacturing sintered magnets (see Patent Documents 1 and 2). Such methods as to manufacture sintered magnets without performing a compression molding process are referred to as "PLP (Press-less Process) methods" in this specification. In such a PLP method, in the filling process of filling a mold with alloy powder as a raw material, the raw material alloy powder may be pushed into the mold with a pressure (about 2 MPa or below) sufficiently lower than a pressure applied to the alloy powder during compression molding (several tens MPa in an ordinary case).

Such a PLP method has, in the main, two advantages described below. A first advantage of the PLP method is in that the manufactured sintered magnets have excellent magnetic properties, notably high coercive force. It is known that the smaller the crystalline particles in a sintered magnet, the higher coercive force the sintered magnet can exhibit. In order to achieve a higher coercive force, it is therefore necessary to make the size of alloy powder as small as possible at the preparation stage of alloy powder as a raw material. Then, the surface area of the alloy powder particles as a raw material becomes large; as a result, the particles become vulnerable to oxidation. When magnet alloys undergo oxidation, the coercive force and other magnetic properties thereof may rather undergo deterioration, or the magnet alloys may cause spontaneous ignition in the air. It is therefore desirable that the magnet alloys be treated in a low-oxygen atmosphere. In regard to this point, PLP methods make it possible for facilities to have a smaller size than that in press methods because they require no press machine, and hence the facilities in their entirety become easier to place in a low-oxygen atmosphere. In any PLP method, finely pulverized alloy powder as a raw material can therefore be treated while being prevented from suffering oxidation, and therefore, sintered magnets of high coercive force can be obtained by using such the fine alloy powder.

A second advantage of PLP methods consists in that they can provide sintered magnets of shapes close to those of final products without carrying out machining. In press methods, on the other hand, it is necessary to subject the alloy powder as a raw material to press molding, and the shape of sintered magnets obtained at the stage of having undergone the sintering process is limited to a shape having two parallel planes corresponding to a pair of punches in a press machine. In order to manufacture sintered magnets having shapes other than the foregoing shape, the sintered articles obtained in the press method must be subjected to machining. In contrast to this, sintered articles obtained at the stage of having undergone the sintering process in a PLP method come to have almost the same shape as the cavity of a mold used (which is referred to as "near net shape") (see Patent Document 1). Accordingly, it becomes possible to obtain sintered magnets of intended shape by adjusting in advance the shape of mold's cavities to the shape of the final products, without carrying out machining.

Because sintered articles generally have undergone shrinkage during the sintering, the sintered articles (and sintered magnets) after sintering are smaller in size than the mold's cavities. At the time when the sintering shrinkage occurs, friction arises between the sintered article and the mold. Accordingly, Patent Document 2 has used a carbon material with a small friction against sintered articles for at least part of the mold, notably as a material for the floor plate. In Patent Document 2, for example, there is a description such that a mold constituted of a stainless steel body having a cavity in the shape of a cuboid and a lid made of a carbon fiber-reinforced carbon composite (C/C composite) is prepared, the cavity is filled with alloy powder as a raw material, the lid is put on the mold, then the orienting process is carried out, further the mold is turned upside down, and thereby the lid made of the carbon material is utilized as the floor plate of the mold. According to such a method, since the carbon fiber-reinforced carbon composite, which is a special and high-priced material, is used only for the lid, cost savings can be made.

Since PLP methods each have the foregoing two advantages, the sintered magnets manufactured in accordance with them can be used suitably for the rotors and stators of motors in particular. An explanation for the case of using a sintered magnet for the rotor (the case in which the stator is an electromagnet) is given below. Likewise, the case of using a sintered magnet for the stator (the case in which the rotor is an electromagnet) can be explained.

During the rotation of a motor, the rotor moves in an external magnetic field generated by the stator, and thereby the direction of the external magnetic field applied to a magnet of the rotor varies drastically. In such a circumstance, a sintered magnet used for the rotor has to maintain magnetization against the external magnetic field, and therefore is required to have high coercive force, which is an indicator of such a capability. In addition, the rotor in use undergoes a temperature rise from room temperature to about 200° C. in the case of a car's motor, and hence sintered magnets having high coercive force over all of such a temperature range have been required. By virtue of the first advantage of PLP methods, sintered magnets having such a high coercive force can be made suitably in accordance with the PLP methods.

In addition, as shown in, for example, Patent Document 3, the rotor is generally used in a shape that two or more sintered magnets each having a front surface which is partially cylindrical in shape are combined together so as to make the front surface of the rotor in its entirety into a cylindrical face. A back surface (a surface opposed to the front surface) of each sintered magnet is, though may be a partially cylindrical face similarly to the front surface, planar in shape in Patent Document 3, and the rotor in its entirety has a convex shape, that is, it is thick in the vicinity of a center in its rotational direction and thin in the vicinities of both ends thereof. To this sintered magnet is applied a magnetic field in the thickness direction during the orienting process, and thereby magnetization is imparted in the thickness direction of the sintered magnet. By virtue of the second advantage of a PLP method, the sintered magnet in such a shape can be made suitably through the use of a mold constituted of a main body having a cavity convex in a downward direction and a lid having a flat face to be pressed and in accordance with the PLP method.

Patent Document 1: JP-A-2006-019521
Patent Document 2: JP-A-2009-049202
Patent Document 3: JP-A-2015-050880

SUMMARY OF THE INVENTION

In the case of making sintered magnets in the foregoing shape by the use of a PLP method, cracking occurred with a higher probability than in the case of making sintered magnets into cuboids by the same method, and lowering of yield rates was brought about.

There has been described the case of making sintered magnets having a shape that their central portions are thick and both end portions thereof are thin, or a convex shape. It can be considered that all the cases wherein sintered magnets have shapes nonuniform in thickness, also including a concave shape which, contrary to a convex shape, has a thin central portion and thick end portions, are supposed to be lower in yield rate because of the occurrence of cracking than the case of sintered magnets having uniform thickness, such as those having the shape of a cuboid.

An object of the present invention is to provide a sintered magnet manufacturing method which allows high-yield manufacturing of sintered magnets having shapes nonuniform in thickness.

In the course of performing analysis on cracks caused in convex sintered magnets, the present inventors have found that cracks appeared in larger numbers in the vicinity of both ends than in the central portion of a convex form.

Then the present inventors have determined the shape of a sintered article after the sintering process in simulations on the basis of the shape of a cavity used and the shrinkage rates of the article under sintering. By the way, it is known that the shrinkage rate under sintering has such direction dependence as to be greater in the orientation direction of alloy powder as a raw material. For example, in an RFeB base sintered magnet containing $R_2Fe_{14}B$ as its main phase, wherein R stands for a rare earth element, Fe stands for iron and B stands for boron, the shrinkage rates determined experimentally under conditions that the sintering temperature was 985° C. and the filling density was 3.4 g/cm$^3$ were about 35% in an orientation direction of alloy powder used as a raw material and about 14% in the direction perpendicular to the orientation direction. As a result of determining the shape of the sintered magnet in a simulation using those shrinkage rates under the condition of adjusting the orientation direction to be perpendicular to the direction of pressurizing a lid surface, the shape drawn in a chain double-dashed line as illustrated in (a) of FIG. 1 was obtained. When this simulation result was drawn in a situation that the shape of a cavity was convex toward a lower place so as to be in conformity with the actual process, it turned out that, as illustrated in (b) of FIG. 1, the sintered article (drawn in a chain double-dashed line) was in contact with (supported by) the cavity (illustrated in a solid line) only in the vicinities of both ends and floated over the cavity surface in the neighborhood of the center.

Then the sintered magnets after the sintering process were observed in detail, and thereby it was ascertained that, as shown in FIG. 2, there were imprints of contacts of sintered magnets with the cavities in the vicinities of ends of convex shapes (in portions each of which is enclosed elliptically in a solid line in FIG. 2), while there were almost no imprints of such contacts in the neighborhood of the center of each convex shape.

From these facts, it can be considered that, as a result of occurrence of sintering shrinkage during the sintering process, each sintered article is brought into contact with each cavity only in the vicinities of both ends of its convex shape and causes a slip (friction) on the contact portions of the cavity, thereby coming to have a number of cracks in the neighborhood of the contact portions.

Thus the present inventors have conceived that, if the sintering process is carried out in a situation that the flat surface side of a cavity, not the non-flat surface side, is laid downward, the sintered article can be prevented from having cracks attributed to local slips (friction), thereby having come to make the present invention.

A sintered magnet manufacturing method relating to the present invention which is made for the purpose of solving the foregoing problem uses:

a mold provided with a main body having a cavity whose lower face is non-flat and a lid whose inner face that is to cover the top of the cavity is flat, and the method contains:

a filling process of filling alloy powder as a raw material in the cavity of the mold and then mounting the lid on the main body, an orienting process of applying a magnetic field in a predetermined direction to the alloy powder in a state of being filled in the cavity, a sintering process of sintering the alloy powder by heating the alloy powder in a state of being filled in the cavity after the orienting process, and a mold inverting process of turning the mold upside down, in which the mold inverting process is carried out between the filling process and the orienting process or between the orienting process and the sintering process.

According to the present invention, the mold is turned upside down in order to lay the inner face of the lid on the downward side between the filling process and the orienting process or between the orienting process and the sintering process. By doing so, sintering shrinkage occurs in the sintering process as the inner flat face of the lid is kept in full-face contact with the raw material alloy powder. Thus, it becomes possible to prevent cracks from occurring owing to local slip (friction) on the underside of a sintered article The mold inverting process is preferably carried out between the filling process and the orienting process. By carrying out the orienting process after having inverted the mold, it becomes possible to prevent the orientation from falling into disorder at the time of inversion of the mold.

There are no particular restrictions as to materials for the lid, but the lid material is preferably a carbon material in point of reduction in friction arising throughout all of the inner face of the lid at the time of occurrence of sintering shrinkage.

The shape of the lower face of the cavity has no particular restrictions so long as it is non-flat, but in the case of manufacturing sintered magnets for use in the rotors of motors, the shape concerned is preferably the shape of a partially cylindrical face which is convex downwardly.

The direction in which a magnetic field is applied during the orienting process is not particularly restricted, but in the case of manufacturing sintered magnets for use in the rotors of motors, the direction concerned is preferably adjusted to the direction perpendicular to the inner face of the lid (the vertical direction of the mold).

The inner face of the lid in the present invention may be allowed to be more or less uneven, but it is preferably a mirror-finished surface.

The sintered magnets manufactured in accordance with the present method have no particular restrictions as to the compositions thereof. The present method allows suitable manufacturing of not only the RFeB base sintered magnets which are great in residual magnetic flux density and maximum energy product but also RCo base sintered magnets which contain as their individual main phases $RCo_5$ and $R_2Co_{17}$ wherein R stands for a rare earth element and Co stands for cobalt.

According to the present invention, cracks ascribable to local slip (friction) on the underside of a sintered article can be prevented from occurring by giving a flat shape to one of the mold' faces situated in the direction corresponding to the thickness direction of sintered magnets intended for manufacturing and, before the sintering process, by turning the mold upside down so that the flat face is situated on the downward side. Therefore, the sintered magnets nonuniform in thickness can be manufactured in a high yield.

DETAILED DESCRIPTION OF THE INVENTION

Embodiments of a sintered magnet manufacturing method relating to the present invention will be explained by reference to FIG. 3 to FIG. 9.

Figure 3:
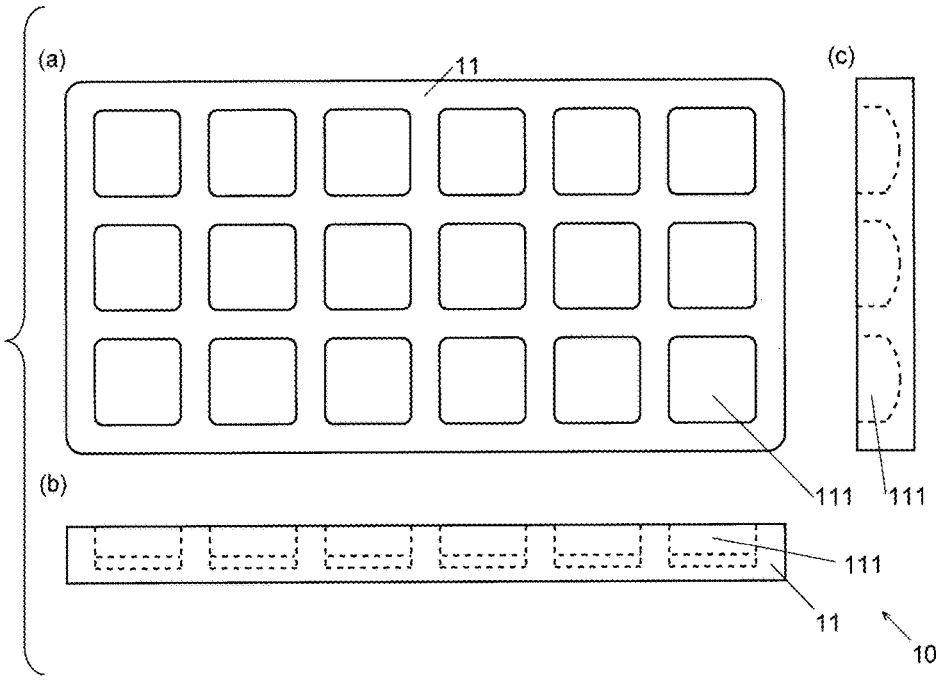
FIG. 3 includes drawings illustrating a mold used in an embodiment of the present invention relating to a method for manufacturing sintered magnets: (a) is a top view, (b) is a front view, and (c) is a side view.

In the method for manufacturing sintered magnets in accordance with an embodiment of the present invention, a mold 10 having the shape illustrated in FIG. 3 is used. The mold 10 is a mold for use in manufacturing a plurality of sintered magnets at the same time. The mold 10 is provided with a plate-shaped main body 11 having spaces 111 arranged in the form of a matrix with 3 rows and 6 columns. Each space 111 has an opening on the top-face side of the main body 11, while on the bottom side it has a face assuming a curved shape like a downwardly-convex partially cylindrical face (each of curves illustrated in broken line in (c) of FIG. 3).

Figure 4:
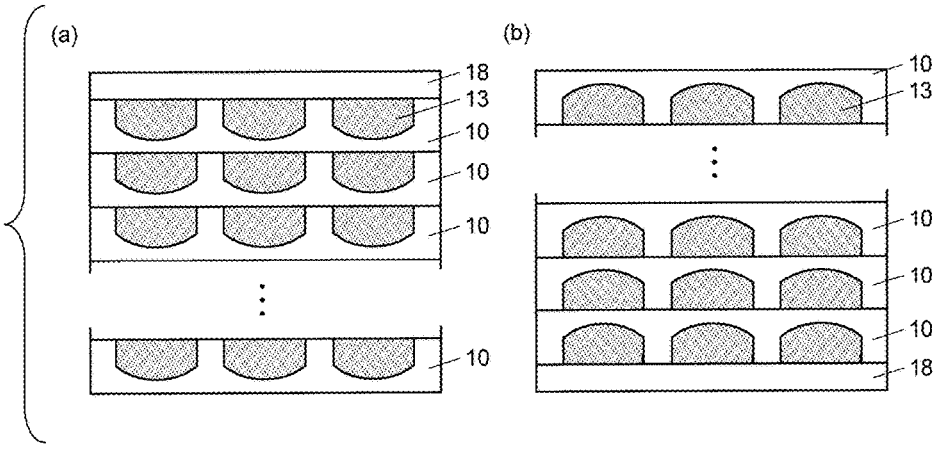
FIG. 4 includes vertical cross-sectional views of mold configurations used in an embodiment of the present invention relating to a method for manufacturing sintered magnets: (a) illustrates a usage pattern of molds before the mold inverting process and (b) illustrates a usage pattern of the molds after the mold inverting process.

The mold 10 is, as illustrated in (a) of FIG. 4, used in such a form that a plurality of main bodies 11 are stacked in layers. The underside of each main body 11 is flat, and by staking some main body 11 on the top of another main body 11 are formed cavities 13 each of which is surrounded by the bottom face and the side face of a space 111 and the underside of the upper main body 11. Consequently, the underside of the upper main body 11 has a function as a lid of each cavity 13. Hereafter, the curved face of the bottom of a space 111 is referred to as "a curved face" of a cavity 13, and the underside of a main body 11 covering the top of a space 111 is referred to as "a flat face" of a cavity 13. In addition, as illustrated in (a) of FIG. 4, a plate-shaped lid 18 different from each mold 10 is mounted on the spaces 111 provided in the uppermost main body 11.

As materials not only for each main body 11 but also for the lid 18, carbon fiber-reinforced carbon composite materials are used in this embodiment of the present invention.

By referring to FIG. 4 and (a) of FIG. 5, a method of manufacturing sintered magnets in accordance with this embodiment of the present invention is explained below.

Figure 5:
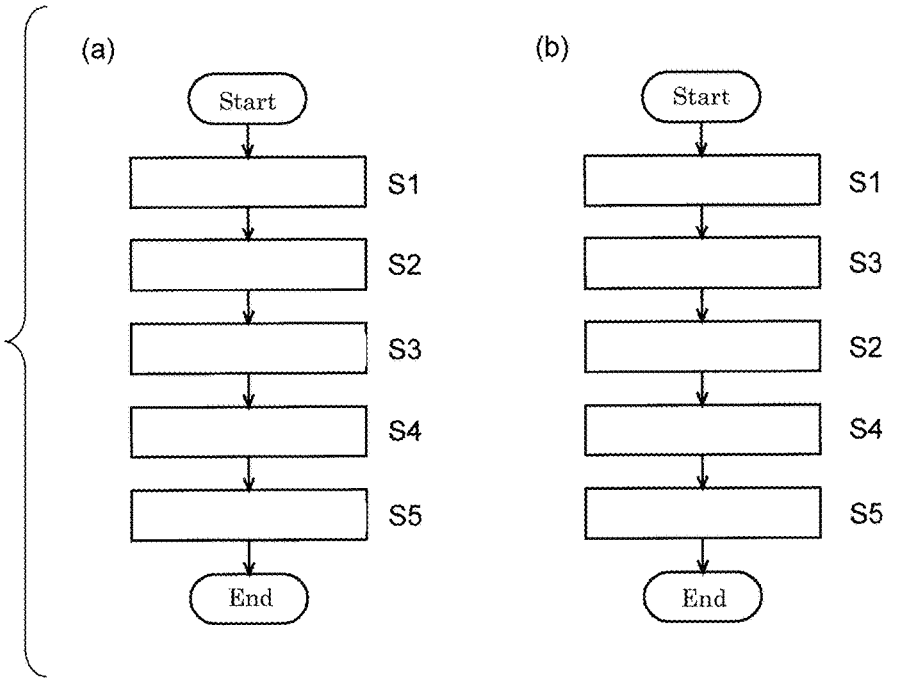
FIG. 5 includes flow charts illustrating sintered magnet manufacturing methods complying with an embodiment (a) and a modified embodiment (b) of the present invention.

To begin with, each of spaces 111 in a plurality of molds 10 is supplied with alloy powder as a raw material for sintered magnets so as to be filled exactly with the alloy powder (filling process, Step S1 in (a) of FIG. 5). During this filling process, the alloy powder supplied may be pressed in each space 111 with a sufficiently low pressure (at most about 2 MPa) as compared to a pressure applied in the case of performing compression molding. In the case where filling density of the alloy powder pressed in such a way is too low, the probability of occurrence of cracks in sintered articles becomes high (irrespective of whether the method of the present invention is used or not). On the other hand, in the case where the filling density is too high, it becomes difficult to orient the alloy powder in the orienting process mentioned below. In the case of RFeB base sintered magnets, for example, the filling density is preferably adjusted to from 3.35 g/cm$^3$ to 3.60 g/cm$^3$. And by stacking a plurality of molds 10 as illustrated in (a) of FIG. 4, a cavity 13 is formed in each space 111. The alloy powder used as the raw material may be prepared by a conventional method, similarly to traditional ones. For example, as described in Patent Document 1, an RFeB base alloy ingot manufactured by a strip cast method is roughly crushed by the use of a hydrogen occlusion method, and then pulverized by means of a jet mill into particles having an average particle diameter of several microns (3 μm or smaller, by way of example, as a median value measured by a laser method). By the way, as mentioned above, a lid 18 is mounted on the uppermost main body 11.

Next, as illustrated in (b) of FIG. 4, the whole of a stacked structure with a plurality of molds 10 is turned upside down (mold inverting process, Step S2 in (a) of FIG. 5). By doing so, the flat face of each cavity 13 is situated on the downside and the curved face on the topside. In this situation (as the raw material alloy powder is filled in each cavity 13), a magnetic field is applied to each and every mold 10 in the direction perpendicular to its flat face. As a result, there occurs orientation of the raw material alloy powder so as to make the easy magnetization axes of crystals in the raw material alloy powder align parallel to the applied magnetic field (orienting process, Step S3 in (a) of FIG. 5). In this step, it is preferred that a strong magnetic field about several tesla in magnetic flux density be applied by the use of a pulsed magnetic field. By the way, as illustrated in (b) of FIG. 5, it is possible to perform the orienting process first and then perform the mold inverting process, but in order to prevent the orientation from fall into disorder at the time of the mold inverting process, it is preferred that, as illustrated in (a) of FIG. 5, the mold inverting process be carried out prior to the orienting process for causing orientation in the raw material alloy powder.

Subsequently, the whole of the stacked structure with a plurality of molds 10 is placed in a sintering furnace, the raw material alloy powder is heated as it is filled in each cavity 13, and thereby the raw material alloy powder in each cavity 13 is sintered (a sintering process, S4 in (a) of FIG. 5). In the case of RFeB base sintered magnets, for example, the sintering temperature can be chosen from a range of from 800° C. to 1,100° C., but it is preferred that the sintering temperature be adjusted to 1,000° C. or lower because too high a sintering temperature promotes grain growth to result in lowering of coercive force.

In embodiments of the present invention, no compression molding is given to the alloy powder during any of the processes mentioned above (PLP method).

After the completion of the sintering process, sintered articles are taken out of the molds 10 and subjected to predetermined after-treatments (after-treating step, Step S5 in (a) of FIG. 5), and thereby sintered magnets are completed.

The after-treatments include a grain boundary diffusion treatment, magnetization and so on. The grain boundary diffusion treatment is a treatment carried out in the course of the manufacturing of RFeB base sintered magnets, and more specifically, it is a treatment that powder or the like containing heavy rare earth element(s) $R^H$ including at least one rare earth element selected from Dy, Tb and Ho is made to adhere to the surfaces of sintered articles, the sintered articles are heated up to a temperature in a range of from 700° C. to 950° C. as the powder gets stuck thereto, and thereby the heavy rare earth element(s) $R^H$ is(are) made to diffuse into the grain boundaries of the sintered articles. By performing such a grain boundary diffusion treatment, the RFeB base sintered magnets are improved in coercive force without attended by reduction in residual magnetic flux density and maximum energy product. The magnetization is a treatment for magnetizing the sintered articles by applying thereto a magnetic field perpendicular to the flat faces once again, because the magnetism of the sintered articles has disappeared at the time of completing the sintering process through the heating at a high temperature during the sintering process. Incidentally, it is feared that shipping large numbers of sintered magnets after subjecting them to magnetization will adversely affect their surrounding environments during transport owing to the magnetic field generated by the sintered magnets. Accordingly, a producer of sintered magnets and a producer of devices using the sintered magnets, including motors and so on, may cooperate with each other so that the former makes a shipment of sintered magnets without subjecting them to magnetization and the latter carries out magnetization of the thus shipped sintered magnets. By the way, traditional press methods perform grinding as an after-treatment for the purpose of machining sintered articles into the final shapes of the intended products, but embodiments of the present invention can eliminate the need for the grinding as shape machining by virtue of adoption of the PLP method.

EXAMPLES

Experiments in the manufacture of RFeB base sintered magnets through the use of the foregoing methods, and simulation results thereof conducted are illustrated below.

Figure 6:
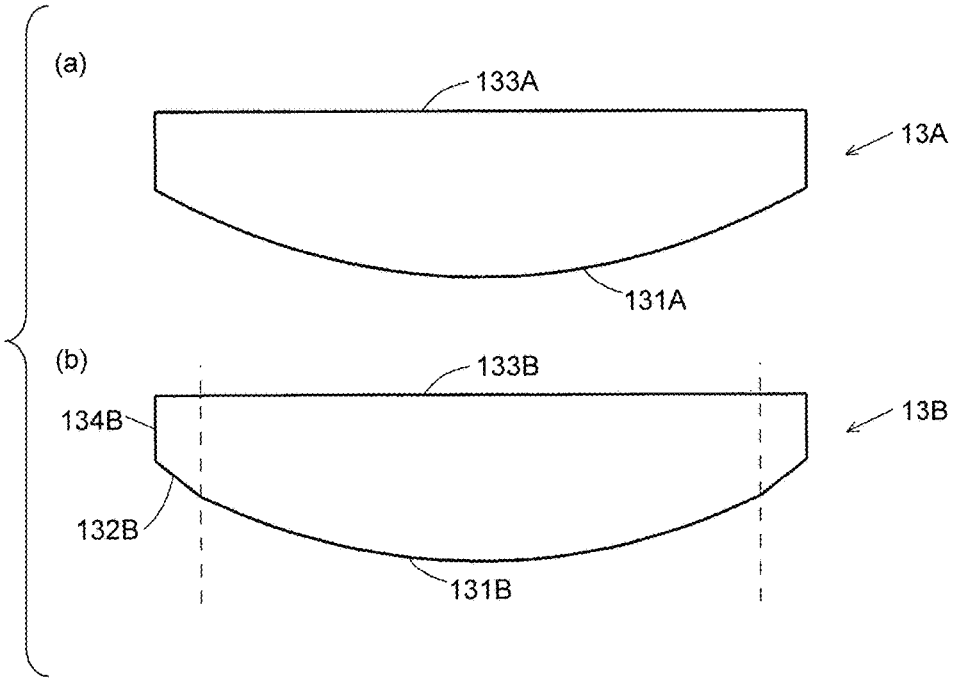
FIG. 6 includes vertical cross-sectional views (a) and (b) illustrating the shapes of two varieties of mold cavities which are used in performing experiments to manufacture sintered magnets by using the method complying with an embodiment of the present invention.

In the experiments, two varieties of molds, one having cavities 13A and the other having cavities 13B, which are illustrated in (a) and (b) of FIG. 6, respectively, were used. The cavity 13A illustrated in (a) of FIG. 6, as with the cavity used in the simulation illustrated in FIG. 1, has a partially cylindrical face 131A and a flat face 133A opposite thereto. The cavity 13B illustrated in (b) of FIG. 6 has a curved face which is formed of a partially cylindrical face 131B and tapered portions 132B each of which is provided on either end of the face 131B and inclined toward a flat face 133B. At either end of the cavity 13B, the tapered portion 132B intersects with the face 134B perpendicular to the flat face 133B. The tapered portions 132B are provided for the purpose of forming, in a sintered magnet to be made in the cavity, a face to be brought into contact with a jig for pressing the sintered magnet at the time when the sintered magnet is mounted in the rotor of a motor.

Figure 1:
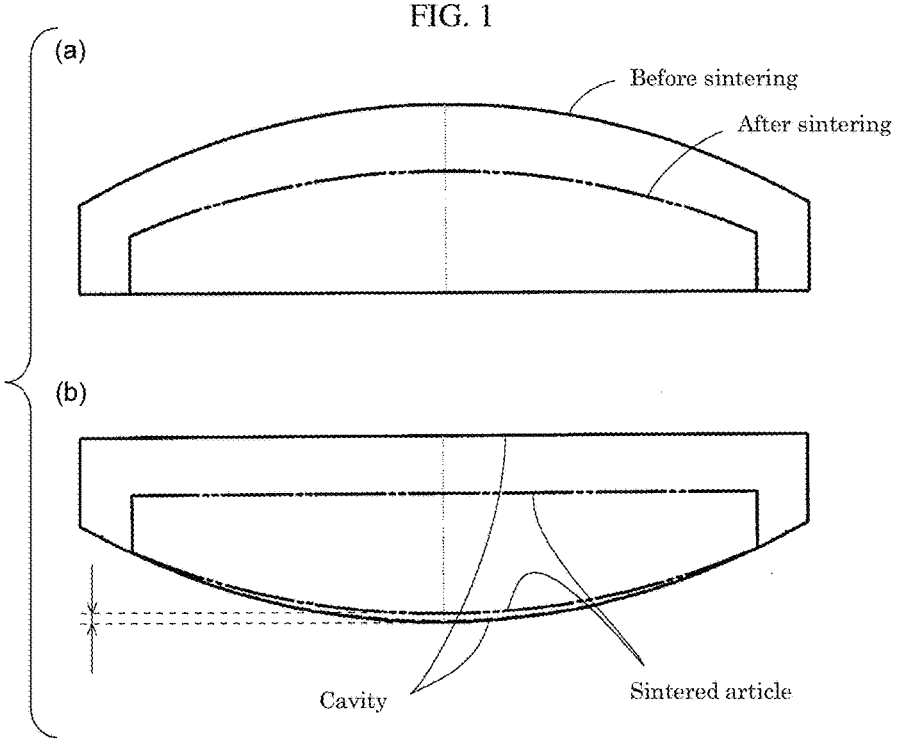
FIG. 1 includes: (a) a drawing illustrating a simulation result on a shape difference between before and after the sintering process in the course of manufacture of a sintered magnet having a shape that non-flat and flat faces are opposite to each other; and (b) a simulation result indicating the problem caused in the conventional manufacturing method.
Figure 2:
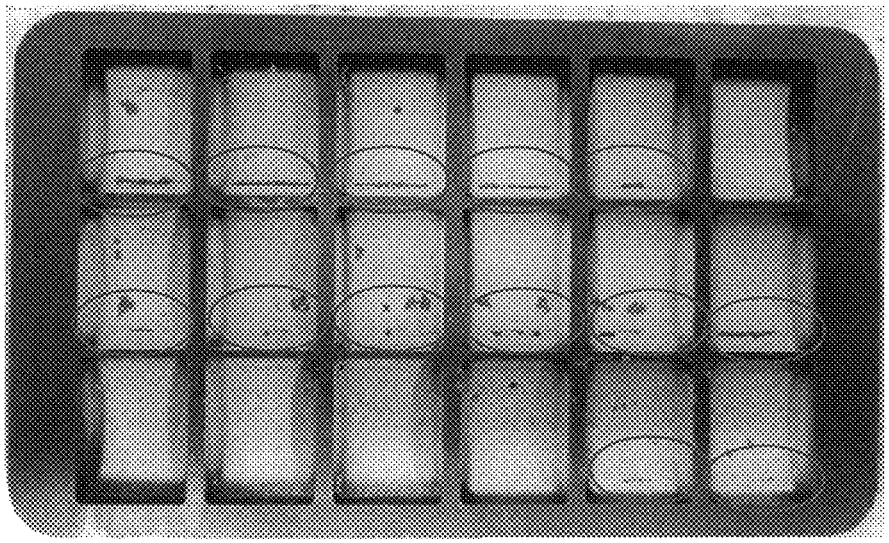
FIG. 2 is a photograph showing the underside of cavities in a mold after use in the case of manufacturing sintered magnets each having a shape that non-flat and flat faces are opposite to each other in accordance with the conventional manufacturing method.
Figure 7:
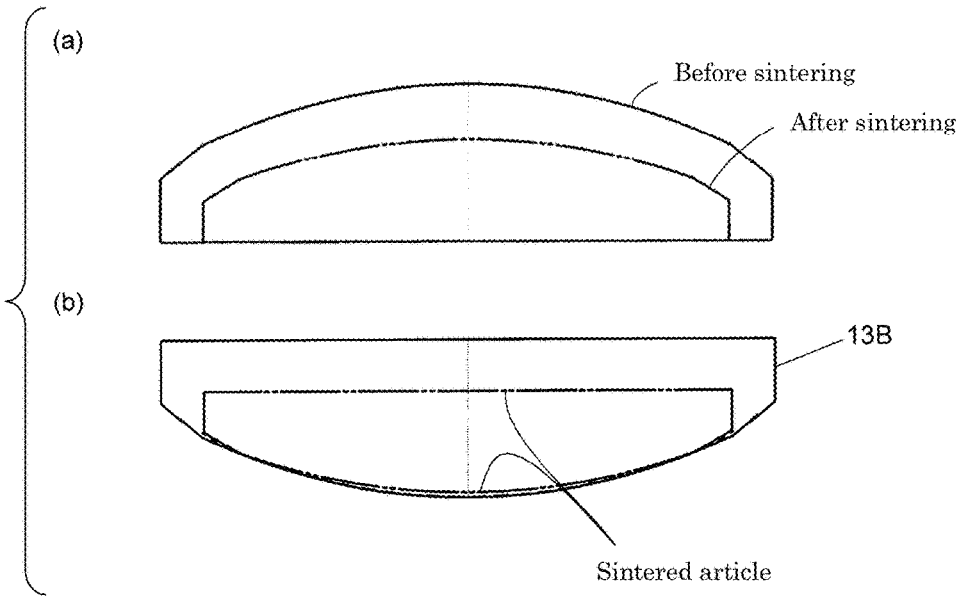
FIG. 7 includes: (a) a drawing illustrating a simulation result on a shape difference between before and after the sintering process in the course of manufacture of a sintered magnet through the use of the cavity shown in (b) of FIG. 6; and (b) a simulation result indicating the problem caused in the conventional manufacturing method.

The result of a simulation performed by using the cavity 13B in a manner similar to the simulation giving the result illustrated in FIG. 1 (the case of using the cavity 13A) is illustrated in FIG. 7. As illustrated in (b) of FIG. 7, the sintered article (chain double-dashed line) is, similarly to FIG. 1, in contact with (supported by) the cavity (solid line) only in the vicinities of both ends, and floats over the cavity surface in the neighborhood of the center. As a result, in the case where a sintered magnet is manufactured by using the cavity 13B as it is oriented as illustrated in (b) of FIG. 7 in common with the traditional way, there occurs, as in the case of using the cavity 13A, a slip (friction) only in the vicinities of both ends of the sintered article at which the sintered article is in contact with the cavity, owing to sintering shrinkage during the sintering process, thereby resulting in occurrence of cracks in such vicinities.

Figure 8:
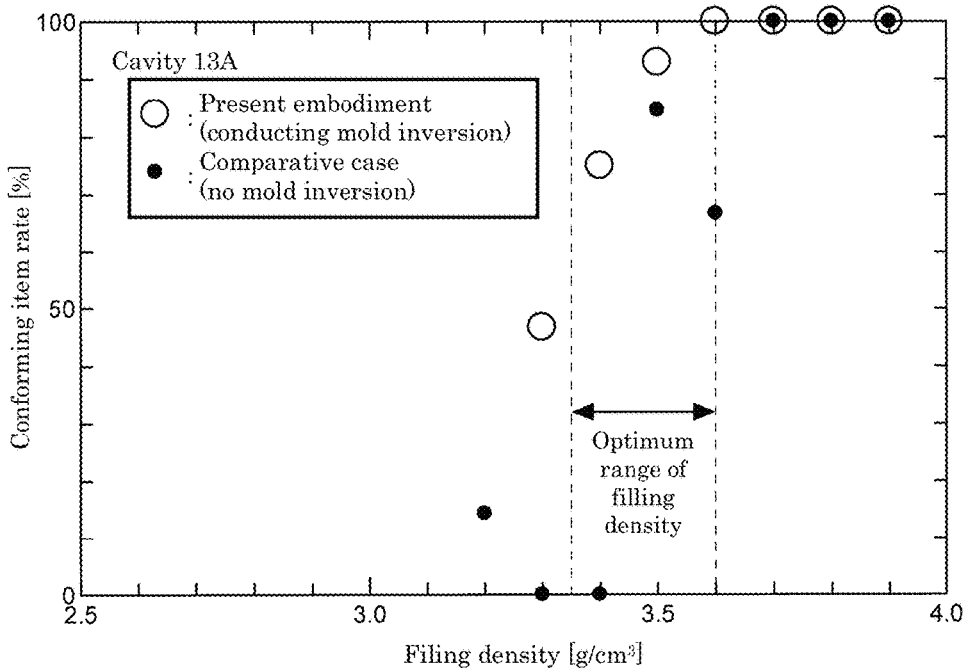
FIG. 8 is a graph showing conforming item rates (yield rates) of RFeB base sintered magnets manufactured through the use of the cavities having the shape illustrated in (a) of FIG. 6.
Figure 9:
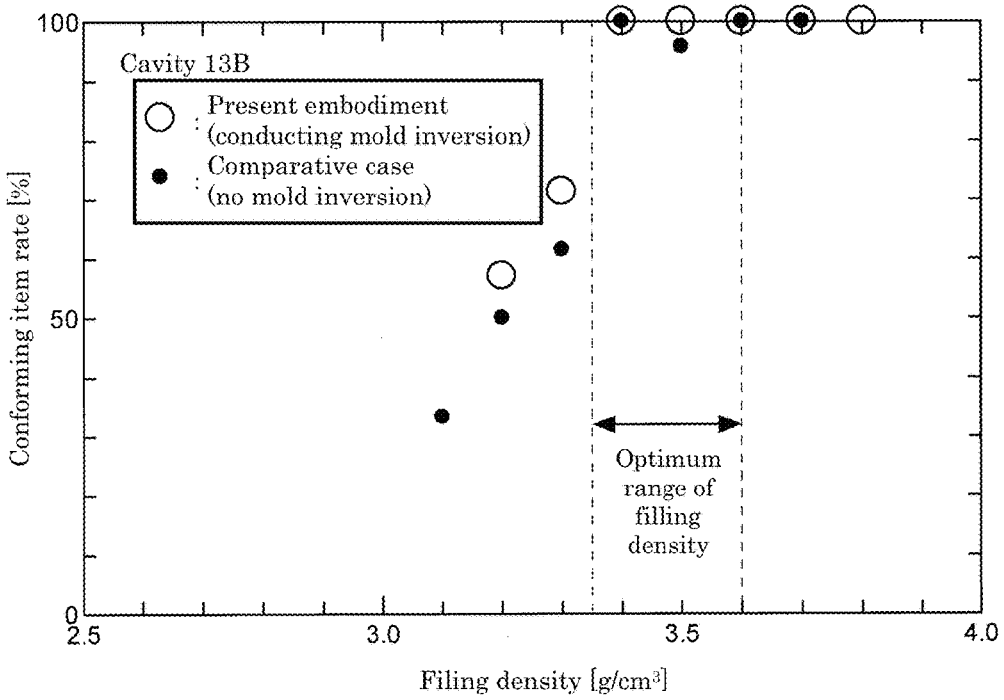
FIG. 9 is a graph showing conforming item rates (yield rates) of RFeB base sintered magnets manufactured through the use of the cavities having the shape illustrated in (b) of FIG. 6.

In experiments of this Examples, RFeB base sintered magnets were manufactured under several conditions differing in filling density, in accordance with the process illustrated in (a) FIG. 5. And the conforming item rate in each experiment was determined by dividing the number of crack-free conforming items by the total number of the thus manufactured sintered magnets. Such experimental results obtained by using the cavity 13A are shown in FIG. 8, and those obtained by using the cavity 13B are shown in FIG. 9. In each graph are shown conforming item rates determined in comparative eases where the same cavity was used and the sintering process was performed as the curved face of the cavity was situated on the underside without conducting the mold inverting process.

In the case of using the cavity 13A, as shown in FIG. 8, the conforming item rates were higher as a whole in the cases complying with the present embodiment than in the comparative cases, and worthy of special note is that the present embodiment achieved the outstanding conforming item rate of 100% (the number of test specimens: 30) at a filling density of 3.6 g/cm$^3$, which is in the optimum range of filling densities (3.35 g/cm$^3$ to 3.6 g/cm$^3$), in contrast to the conforming item rate of about 67% at the same filling density in the comparative case.

Incidentally, the conforming item rate of 100% was achieved at the filling densities of from 3.7 g/cm$^3$ to 3.9 g/cm$^3$ in not only the cases complying with the present embodiment but also the comparative cases. However, these densities are beyond the optimum density range, and the raw material alloy powder is difficult to orient in the orienting process; as a result, there occurs reductions in residual magnetic flux density and maximum energy product.

In the case of using the cavity 13B as well, as shown in FIG. 9, the conforming item rates were higher as a whole in the cases complying with the present embodiment than in the comparative cases. In addition, the cases complying with the present embodiment achieved the outstanding conforming item rate of 100% (the number of test specimens: 12 to 17) at all the filling densities in the optimum range.

The present invention should not be construed as being limited to the foregoing embodiments.

For example, though the curved face of each cavity was designed to have a downwardly convex shape before the inversion of molds in the foregoing embodiments, the present invention can also be applied to cases where the curved face of each cavity is convex upwardly or more complex in shape.

The number of spaces 111 provided in the main body 11 of each mold 10 is not limited to 3 (in the length direction) by 6 (in the width direction), but it may be any number including 1. In addition, molds usable in the present invention are not limited to the mold formed by stacking a plurality of main bodies of the molds 10 on top of each other, but one main body alone may be used.

As the material for the mold 10, a carbon fiber-reinforced carbon composite material was used in any of the present embodiments, but other carbon materials including graphite and so on may be used.

The present application is based on Japanese patent application No. 2015-146508 filed on Jul. 24, 2015, and contents thereof are incorporated herein by reference.

DESCRIPTION OF REFERENCE NUMERALS AND SIGNS

10: Mold
11: Main body
111: Space
13, 13A, 13B: Cavity
131A, 131B: Partially cylindrical face
132B: Tapered portion
133A, 133B: Flat face
134B: Face perpendicular to flat face 133B
18: Lid

What is claimed is:

1. A method for manufacturing a sintered magnet, using:
a mold provided with a main body having a cavity whose lower face is non-flat and a lid whose inner face that is to cover the top of the cavity is flat, and
the method comprising:
a filling process of filling alloy powder as a raw material in the cavity and then mounting the lid on the main body,
an orienting process of applying a magnetic field in a predetermined direction to the alloy powder in a state of being filled in the cavity,
a sintering process of sintering the alloy powder by heating the alloy powder in a state of being filled in the cavity after the orienting process, and
a mold inverting process of turning the mold upside down, wherein the mold inverting process is carried out between the filling process and the orienting process or between the orienting process and the sintering process.

2. The method according to claim 1, wherein the mold inverting process is carried out between the filling process and the orienting process.

3. The method according to claim 1, wherein the lid is made of a carbon material.

4. The method according to claim 1, wherein the lower face of the cavity has a shape of a partially cylindrical face that is convex downwardly.

5. The method according to claim 1, wherein, in the orienting process, the magnetic field is applied in a direction perpendicular to the inner face of the lid.

* * * * *